US005664398A

United States Patent [19]

Leifeld

[11] Patent Number: 5,664,398

[45] Date of Patent: Sep. 9, 1997

[54] APPARATUS FOR CHARGING FLAT CANS WITH SLIVER AT A SLIVER PRODUCING FIBER PROCESSING MACHINE

[75] Inventor: Ferdinand Leifeld, Kempen, Germany

[73] Assignee: Trützschler GmbH & Co. KG, Mönchengladbach, Germany

[21] Appl. No.: 243,489

[22] Filed: May 16, 1994

[30] Foreign Application Priority Data

May 14, 1993 [DE] Germany ..... 43 16 159.6
Apr. 2, 1994 [DE] Germany ..... 44 11 549.0

[51] Int. Cl.[6] ..... B65B 63/04

[52] U.S. Cl. ..... 53/118; 53/116; 53/235; 53/245; 53/250; 53/64; 53/67; 53/503; 19/159 A; 19/159 R

[58] Field of Search ..... 19/159 R, 159 A, 19/160, 157; 141/168, 283, 163, 167, 175, 250, 267, 270; 53/116, 118, 245, 249, 429, 430, 473, 64, 67, 70, 71, 117, 235, 250, 251, 503; 242/361.4, 361.5, 363

[56] References Cited

U.S. PATENT DOCUMENTS

| | | | |
|---|---|---|---|
| 2,971,244 | 2/1961 | Foller et al. | 53/116 |
| 3,059,308 | 10/1962 | Friedel | 53/116 |
| 3,064,328 | 11/1962 | McClure et al. | 53/116 |
| 3,339,244 | 9/1967 | Van Deusen . | |
| 3,423,807 | 1/1969 | Couturier et al. | 53/116 |
| 3,816,889 | 6/1974 | Crotti | 53/116 |
| 4,709,452 | 12/1987 | Cooley et al. | 19/159 R |
| 4,987,649 | 1/1991 | Meyer et al. | 19/159 A |
| 5,237,726 | 8/1993 | Gartenmann et al. | 19/159 A X |
| 5,412,845 | 5/1995 | Ueding et al. | 19/159 R |

FOREIGN PATENT DOCUMENTS

| | | | |
|---|---|---|---|
| 0 255 880 | 2/1988 | European Pat. Off. . | |
| 0 344 484 | 12/1989 | European Pat. Off. . | |
| 0 457 099 | 11/1991 | European Pat. Off. . | |
| 0 459 956 | 12/1991 | European Pat. Off. . | |
| 0 493 341 | 7/1992 | European Pat. Off. . | |
| 1107566 | 5/1961 | Germany . | |
| 1158420 | 11/1963 | Germany . | |
| 61-37669 | 2/1986 | Japan . | |
| 681450 | 3/1993 | Switzerland . | |
| 333396 | 8/1930 | United Kingdom | 19/159 A |
| 812644 | 4/1959 | United Kingdom . | |
| 855924 | 12/1960 | United Kingdom . | |
| 961775 | 6/1964 | United Kingdom | 53/116 |
| 982380 | 2/1965 | United Kingdom . | |
| 1101765 | 1/1968 | United Kingdom . | |
| 1165193 | 9/1969 | United Kingdom . | |
| 1258009 | 12/1971 | United Kingdom . | |

*Primary Examiner*—Daniel Moon
*Attorney, Agent, or Firm*—Spencer & Frank

[57] ABSTRACT

A system for charging a coiler can of elongated horizontal cross section with sliver obtained from a sliver producing fiber processing machine includes a stationarily supported rotary coiler head discharging sliver in coils; a sled disposed underneath the coiler head for receiving a coiler can in an upright orientation; and a sled-reciprocating device for imparting a rapid back-and-forth motion to the sled during discharge of sliver from the coiler head to effect a deposition of sliver coils into the coiler can along a length thereof.

11 Claims, 11 Drawing Sheets

1
3
2
50
4
7
A
37
B
6
5
6'
13
L
M
54
IXb
53
51
52
55
51a
6a
P
e
IXc
d
51c
6b
c
51b
R
f 70
54
K
I
54a
6a
6b
7
6''
M
L
54b

Fig. 11
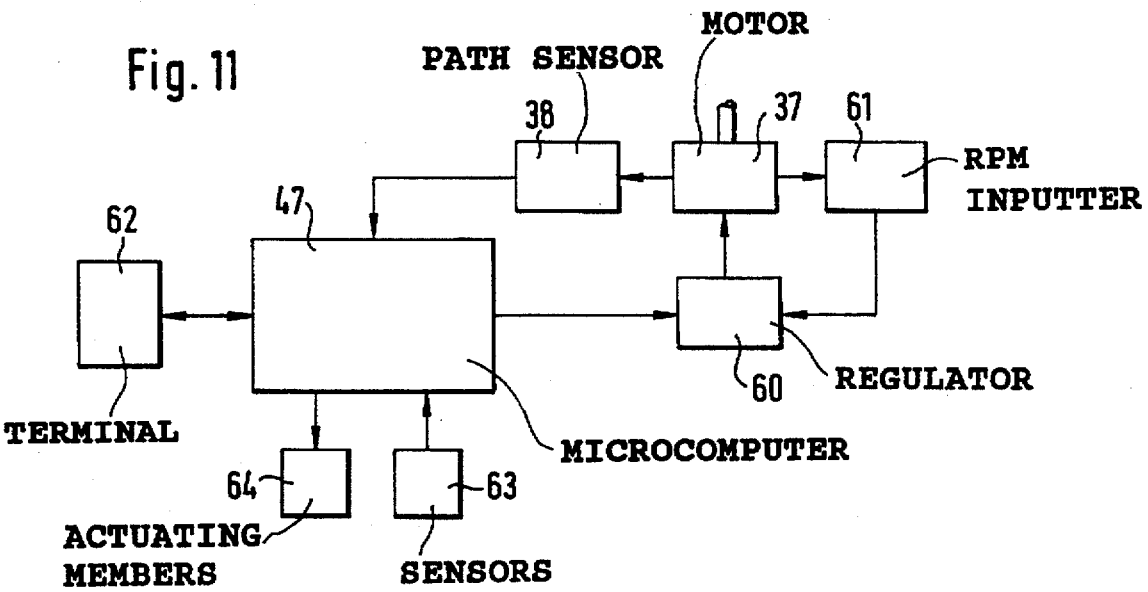
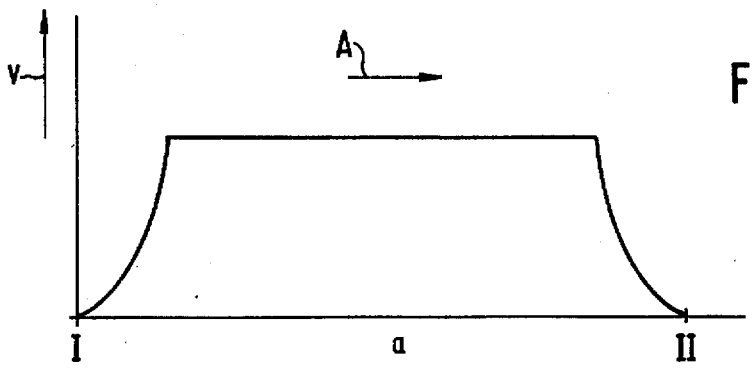
Fig.12a
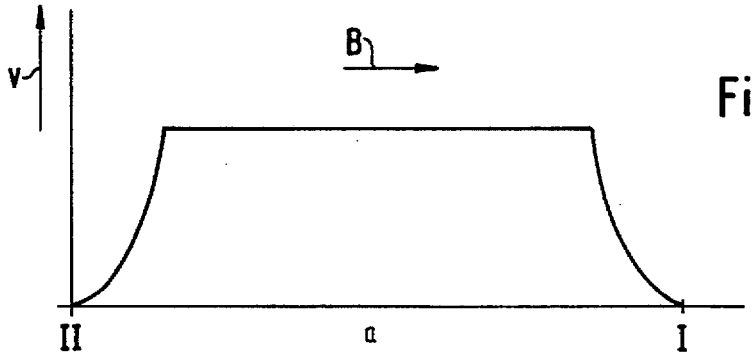
Fig. 12b

APPARATUS FOR CHARGING FLAT CANS WITH SLIVER AT A SLIVER PRODUCING FIBER PROCESSING MACHINE

CROSS REFERENCE TO RELATED APPLICATION

This application claims the priority of German Application Nos. P 43 16 159.6 filed May 14, 1993 and P 44 11 549.0 filed Apr. 2, 1994, which are incorporated herein by reference.

BACKGROUND OF THE INVENTION

This invention relates to an apparatus for charging flat coiler cans (that is, coiler cans which have an elongated horizontal cross-sectional configuration) with sliver at a sliver producing fiber processing machine, such as a drafting frame or a carding machine. The sliver, which may be composed of cotton fibers, chemical fibers or the like, is discharged by a stationary, rotating coiler head and is deposited in coils into the can which stands on a support such as plate, sled, carriage, conveyor belt portion (emplacement) or the like (hereafter generally referred to as "sled") and executes a back-and-forth motion in its horizontal length dimension by virtue of reciprocating the support by a drive mechanism.

German Auslegeschrift (application published after examination) 11 07 566 discloses an apparatus in which the can is standing on a sled in the sliver charging station. The reciprocation of the sled is effected by means of a bidirectionally rotatable threaded spindle on which there is mounted a travelling nut affixed to the sled. The spindle is driven by a rotating component of the coiler head drive. The sled is, together with the can, reciprocated as long as necessary to ensure that the can is filled with the sliver coils. At the end of the reciprocating path the travelling direction of the sled is automatically reversed. It is a disadvantage of this arrangement that driving the sled by a spindle assembly is complex and expensive. It is a further drawback that the back-and-forth motion of the sled is too slow, particularly in current high-output drafting frames which discharge sliver at a speed of 1,000 m/min and above.

SUMMARY OF THE INVENTION

It is an object of the invention to provide an improved apparatus of the above-outlined type from which the discussed disadvantages are eliminated and which, in particular, is structurally simple and makes possible a high-speed reciprocation of the can-supporting member, such as a platform or a sled.

This object and others to become apparent as the specification progresses, are accomplished by the invention, according to which, briefly stated, the system for charging a coiler can of elongated horizontal cross section with sliver obtained from a sliver producing fiber processing machine includes a stationarily supported rotary coiler head discharging sliver in coils; a sled disposed underneath the coiler head for receiving a coiler can in an upright orientation; and a sled-reciprocating device for imparting a rapid back-and-forth motion to the sled during discharge of sliver from the coiler head to effect a deposition of sliver coils into the coiler can along a length thereof.

By virtue of the rapid shifting (reciprocating) device a back-and-forth motion of high speed is possible so that the apparatus according to the invention is particularly adapted for use in high-output drafting frames. Further, the shifting device, in contrast to known two-part structures (spindle and travelling nut) is connected directly with the sled, whereby a structural simplification is achieved.

According to an advantageous feature of the invention, the shifting device is situated underneath the sled. The shifting device has a relatively shallow structural height so that the aggregate as a whole is not significantly enlarged vertically if it is situated underneath the sled. This results in the advantage that in the zone of the can exchanger free spaces remain available adjacent the sled.

Expediently, the sled is connected with guide bars, one of which is supported in a form-fitting manner and the other is attached loosely with a clearance. At least one of the guide bars is a polished circular bar on which the sled glides, guided by a sliding bushing. The second guide bar serves as a movable support to compensate for temperature-caused length variations.

According to a further feature of the invention, the shifting device includes an endless flexible element, such as a flat belt or a toothed belt supported by end rollers (sprockets). The use of flat belts or toothed belts presents a significantly economical solution since they may be mass manufactured.

According to a further advantageous feature of the invention, the flexible element is an endless belt which, at two spaced locations thereof, is affixed to the sled. According to another embodiment, the belt has opposite ends affixed to the sled by means of a securing element. By virtue of the fact that both ends of the flexible element are affixed to the sled it is feasible to realize a further advantageous feature of the invention, that is, to exert with one and the other end of the flexible element a tension force on the sled so that the sled is, for both the forward and return motions, exposed to a pulling force rather than a pushing force.

According to another advantageous feature of the invention, the shifting device includes a reversible motor, for example, a servomotor which is expediently associated with one of the supporting rollers for the belt. Advantageously, the shifting device is associated with a path sensor, such as an optical barrier which detects the motions of the flexible element or the sled. In this arrangement, when the can has reached an end position in the course of its reciprocating motion, it is feasible to reverse the direction of rotation of the motor by a signal from the optical barrier and to thus move the sled in the opposite direction. Expediently, an rpm-regulated electromotor is used as the drive which is connected with a control device for setting predetermined rpm's. Advantageously, the electromotor is a frequency-controlled a.c. servomotor which may be constantly accelerated and decelerated in a wide range. According to another feature of the invention, the electromotor runs at constant speed between an acceleration period and a deceleration period.

According to a further feature of the invention, the amplitude of the back-and-forth displacement corresponds to the horizontal length of the generally rectangular can, less the diameter of the coiler head. By rectangular cans there are meant flat cans with rectangular or oval horizontal cross-sectional configuration. According to a further feature of the invention, the length of the amplitude of the reciprocating motion of the sled is variable. In this manner, cans of different horizontal lengths may be used and the amplitudes adapted to the can length.

If, according to an advantageous feature of the invention, the rotation of the motor is converted to a reciprocating motion of the sled, a further advantageous feature of the invention provides that the flexible element runs continuously in one direction. In view of such an arrangement the drive motor too, runs unidirectionally at all times. In such an arrangement no reversible motor is needed. In such a case the flexible element circulates about a vertical axis and has at least one carrier member which may be connected to or disconnected from the can or the sled. The flexible element may be a belt or a chain on which at least one carrier member is mounted which may be shifted upwardly or downwardly in a carrier guide so that it may engage into a recess provided in the sled. At the reversing points of the flexible element the carrier element may thus be lowered to be disengaged from the sled and after reversal it may be raised again to engage a further recess of the sled to move the latter in the opposite direction.

The sled is provided with sliding or rolling elements for the can, such as sliding shoes, rollers or the like oriented transversely to the direction of the reciprocating motion. The rolling or sliding elements serve for allowing easy shifting of the can onto or out of the sled to thus permit the performance of a can exchanging operation. The rotary coiler head advantageously continues to run with a reduced speed during the can exchanging operation.

According to a further advantageous feature of the invention, on the sled an external shifting mechanism is mounted which serves for a vertical displacement of a movable can bottom within the can and which is displaced back and forth with the sled as a unit. This feature of the invention permits the use of coiler cans which do not have a dual bottom, that is, cans which are structurally much simpler because internal springs may be eliminated which are otherwise necessary to bring the can bottom into its upper position to start the charging operation for an empty can. In this arrangement, the can is provided with vertical slots and the vertically movable can bottom has engagement members attached thereto and projecting outwardly through slots. The external can bottom raising and lowering device may engage the engagement members attached to the can bottom and may raise or lower the same. For this purpose, a single raising and lowering device needs to be mounted on the sled which replaces the conventional springs or lazy tongs devices installed within the can underneath the vertically movable bottom thereof.

BRIEF DESCRIPTION OF THE DRAWINGS

FIG. 11 is a block diagram illustrating an electronic control and regulation of the can reciprocating device according to the invention.

FIGS. 12*a* and 12*b* are diagrams illustrating displacement velocities of the coiler cans during the sliver charging process.

DESCRIPTION OF THE PREFERRED EMBODIMENTS

Figure 1:
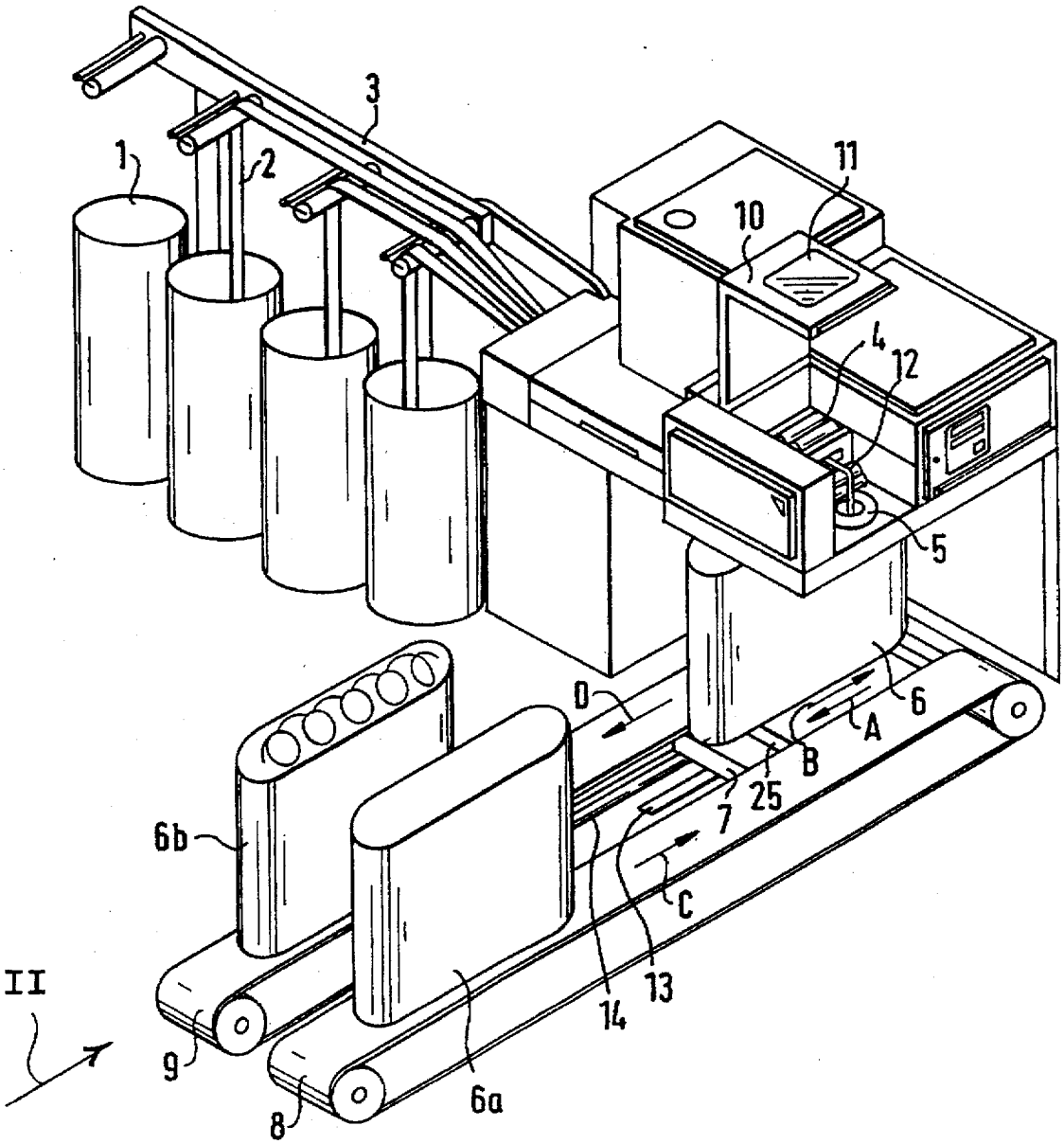
FIG. 1 is a schematic perspective view of a drafting frame in which the invention may find application.

Turning to FIG. 1, a plurality of cylindrical coiler cans 1 are positioned underneath a sliver inlet 3 of a drafting frame which includes a drafting unit 4 to which the slivers 2 are fed simultaneously over rolls. The drafting unit 4, after combining and drafting the slivers 2, discharges a sliver 12 which is advanced into a rotary coiler head 5 for depositing the sliver 12 in coils into a flat coiler can 6 situated below the coiler head 5. The can 6 stands on a sled 7 which, by means of a sled reciprocating device 13, moves with the can 6 back and forth as indicated by the arrows A and B. The drafting unit 4 and the coiler head 5 are protected by a machine cover 10 which is provided with a window 11 for permitting observation of the sliver drafting and depositing operations.

On either side of the sled 7 two parallel extending conveyor belts 8 and 9 are positioned. The conveyor belt 8 serves for delivering empty cans 6*a* in the direction of the arrow C towards the sliver charging station (in which the coiler head 5 operates), whereas the conveyor belt 9 receives full cans 9*b* from the sliver charging station and moves them away therefrom in the direction of the arrow D. During conveyance of the cans on the belts 8 and 9 and while in the sliver charging station, the horizontal length dimension of the cans is parallel to the conveying direction C, D.

Figure 2:
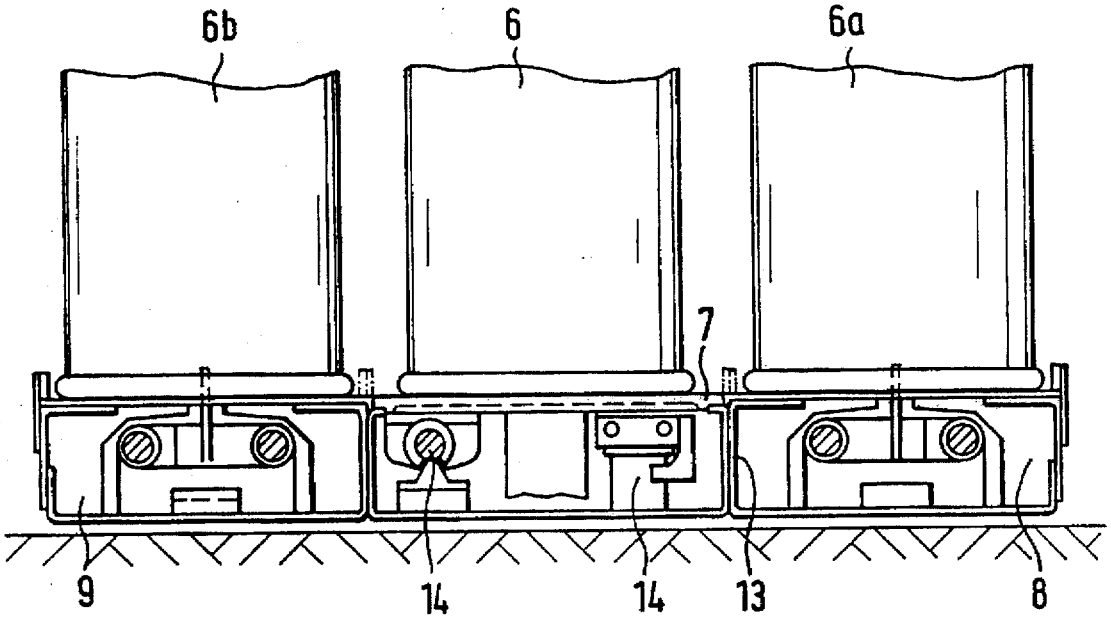
FIG. 2 is a sectional front elevational view of one part of the construction shown in FIG. 1, as seen in the direction of the arrow II.

While in FIG. 1, laterally of the can 6 momentarily no cans are present, FIG. 2 depicts an operational moment where the can 6 undergoing charging is flanked by two cans, namely an empty can 6*a* and a full can 6*b* situated on the conveyor belts 8 and 9, respectively.

Figure 3:
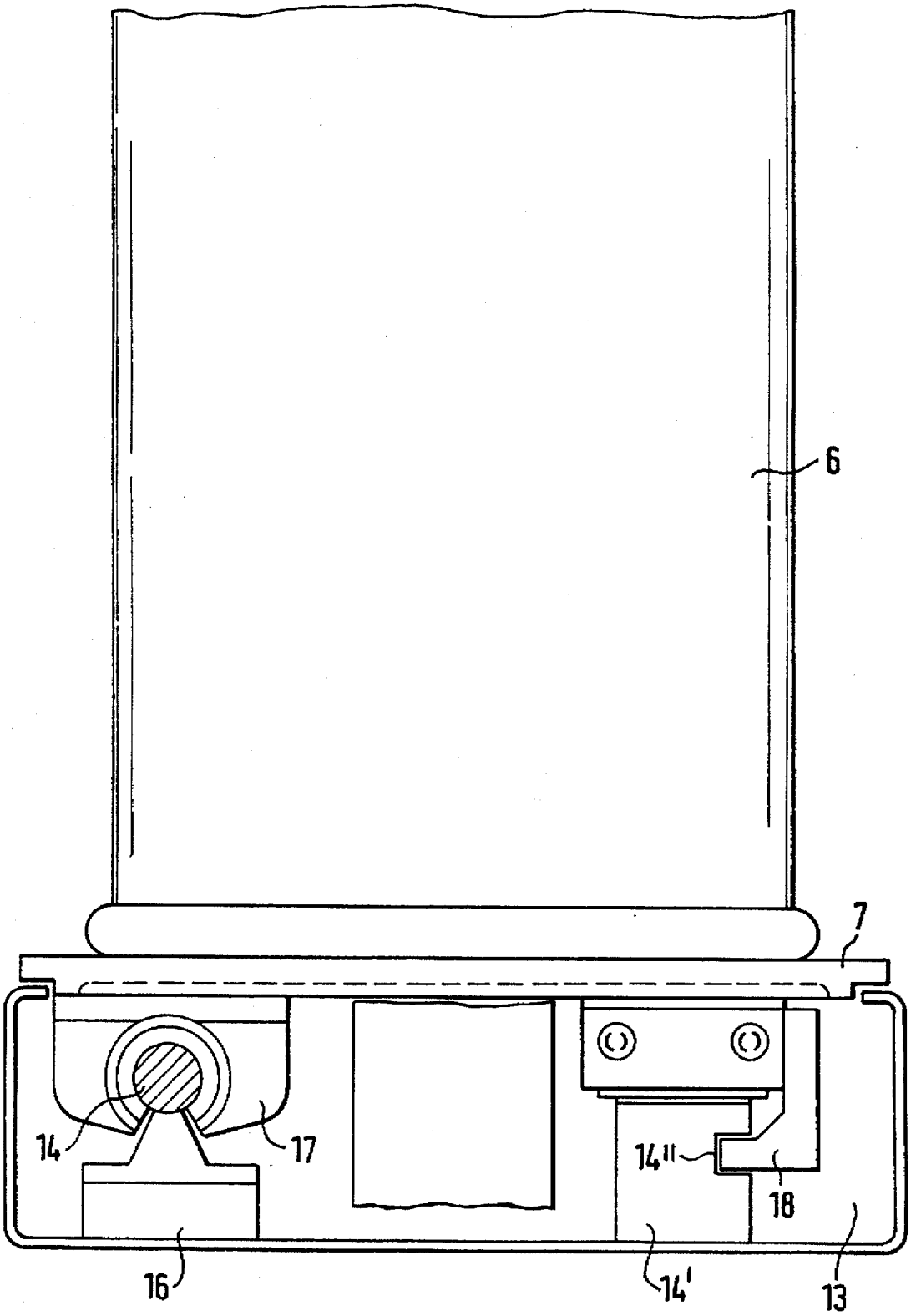
FIG. 3 is an enlarged sectional front elevational view of a detail of FIG. 2.

FIG. 3 shows in further detail an embodiment of the sled reciprocating apparatus 13. The flat can 6 stands on the sled 7, its horizontal length dimension being aligned with the length dimension of the sled 7. At its underside the sled 7 has a sliding guide 17 which surrounds a stationarily supported guide bar 14 supported by a trestle or block 16. A second stationarily supported guide bar 14' extends parallel to the guide bar 14 and has an outer lateral groove 14" which serves as a guide track and into which extends a follower lug 18 secured to the underside of the sled 7. The guide bar 14 is formfittingly supported, while the guide bar 14' is supported with a play to allow for heat expansions. In the alternative or in addition, the sliding guide snugly surrounds the guide bar 14, while the follower lug 18 extends with a play into the groove 14" of the guide bar 14'.

Figure 4:
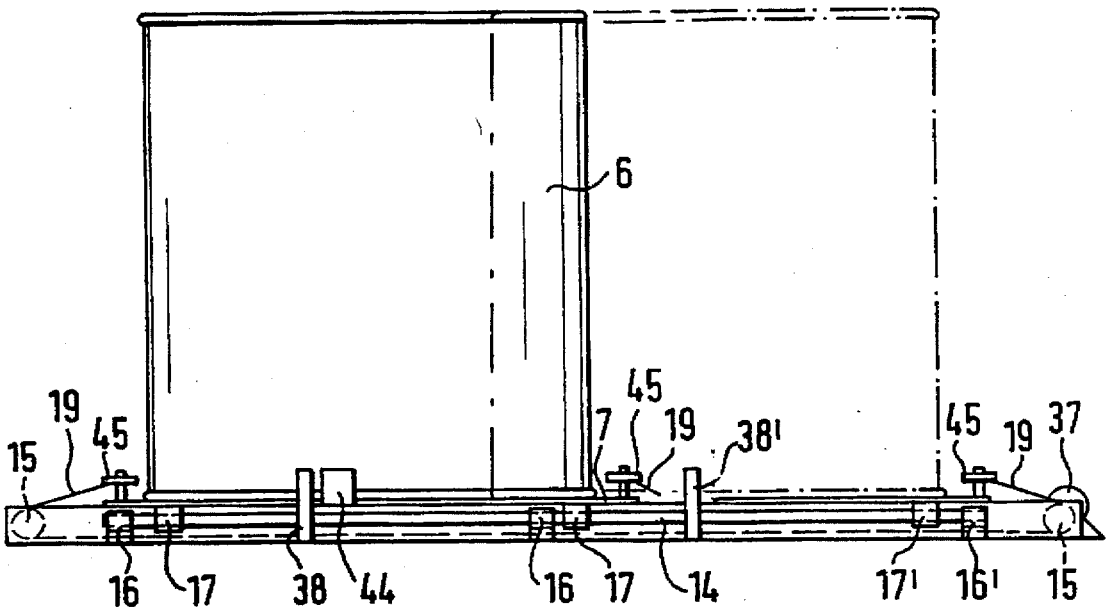
FIG. 4 is a side elevational view of a preferred embodiment of the can reciprocating (can shifting) device according to the invention.

FIG. 4 illustrates a side view of the construction of FIGS. 2 and 3. The guide bar supporting blocks 16 are situated at either end of the displacement path for the reciprocating motion of the sled 7. The power to effect the reciprocating motion is supplied by a reversible motor 37 which, by means of non-illustrated evaluating and control devices which process signals from a path sensor (displacement detector) 38, formed by an optical transmitter and detector, receives signals for reversing the direction of motor rotation from a light reflector 44. The reversible motor 37 is operatively connected to the sled 7 by means of a flexible element 19 which is trained about a belt pulley of the reversible motor 37 and which is affixed to the sled 7 at its opposite ends by means of respective securing posts 45. In the operational phase depicted in FIG. 4, the coiler can 6 is travelling to the left and is depicted at a moment when it is about to reach its left-hand end position. The can is shown in phantom lines in the right-hand end position.

Figure 5:
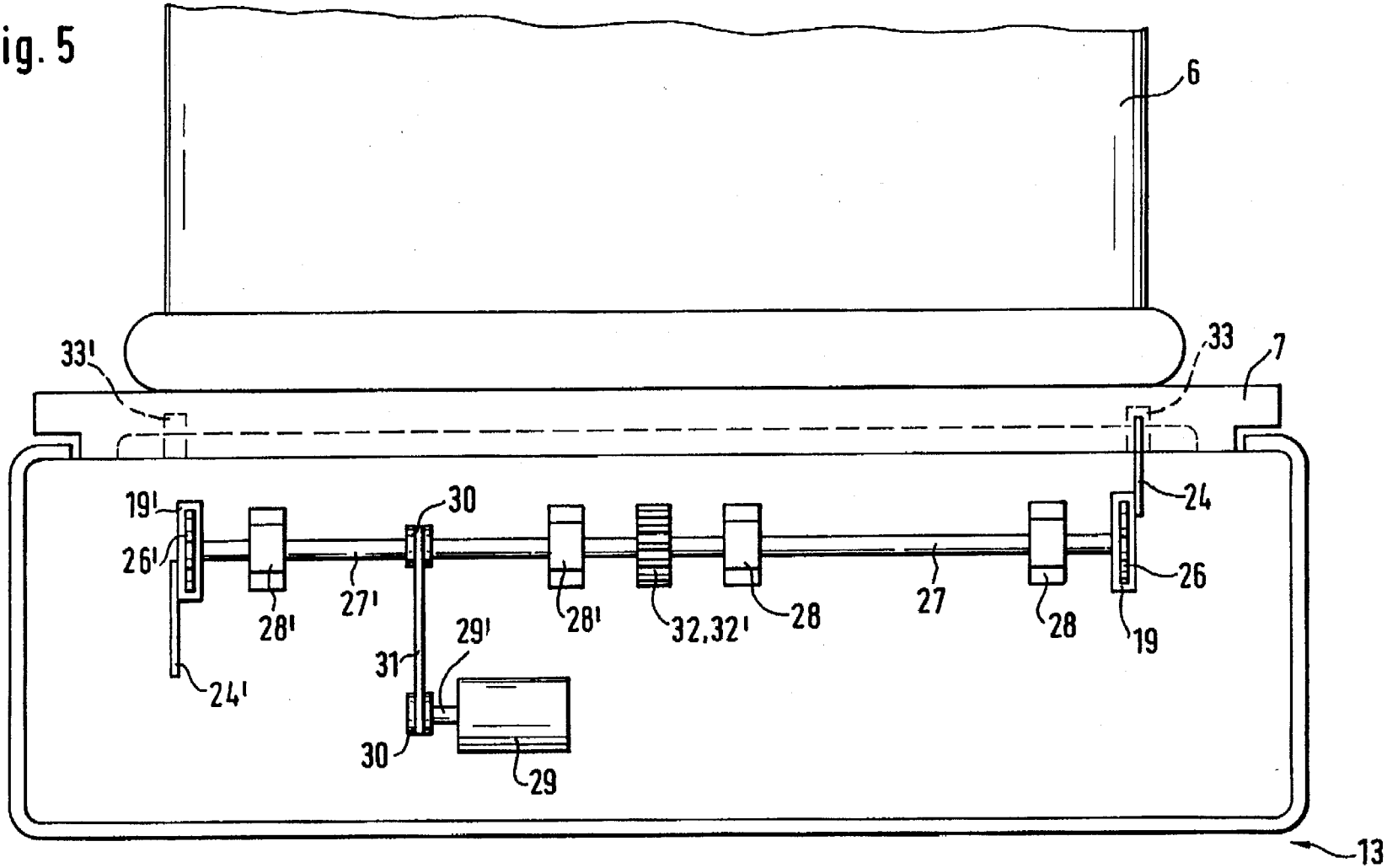
FIG. 5 is a front elevational view of still another preferred embodiment of the invention.

FIG. 5 shows a further embodiment of the reciprocating device 13 in front elevational view. Support blocks 28 and 28' position axially aligned shafts 27 and 27' underneath the sled 7. The shafts 27, 27' are coupled to one another by means of meshing gears 32 and 32' in such a manner that the two shafts rotate in opposite directions when driven by the motor 29 via belt 31 which is trained about pulleys 30 affixed to the shaft 27' and the shaft 29' of the motor 29. At the oppositely oriented outer ends of the shafts 27, 27' sprockets 26, 26' are mounted about which respective flexible elements, constituted by chains 19, 19' are trained. On chains 19, 19' carrier members or carrier elements 24, 24' are mounted in such a manner that when one of the carrier members travels along the upper run of its chain, the other carrier member simultaneously travels along the lower run of its chain. The carrier member 24 when travelling along the upper run of the chain 19 projects into a recess 33 provided in the bottom face of the sled 7 and displaces the sled 7, with the can 6 thereon, in a direction away from the observer. At the and of the displacement path the carrier member 24, as it travels in a circular path about the end sprocket at the far end of the chain 19, moves out of the recess 33 and, at the same time, on the other side, the carrier member 24' as it circularly travels upwardly about the end sprocket at the far end of chain 19', engages into the recess 33' provided in the bottom face of the sled 7 and, since the chain 19' to which the carrier member 24' is attached travels in an opposite sense relative to the chain 19, the sled 7 is now moved in the opposite direction, that is, from the far end towards the observer.

Figure 6:
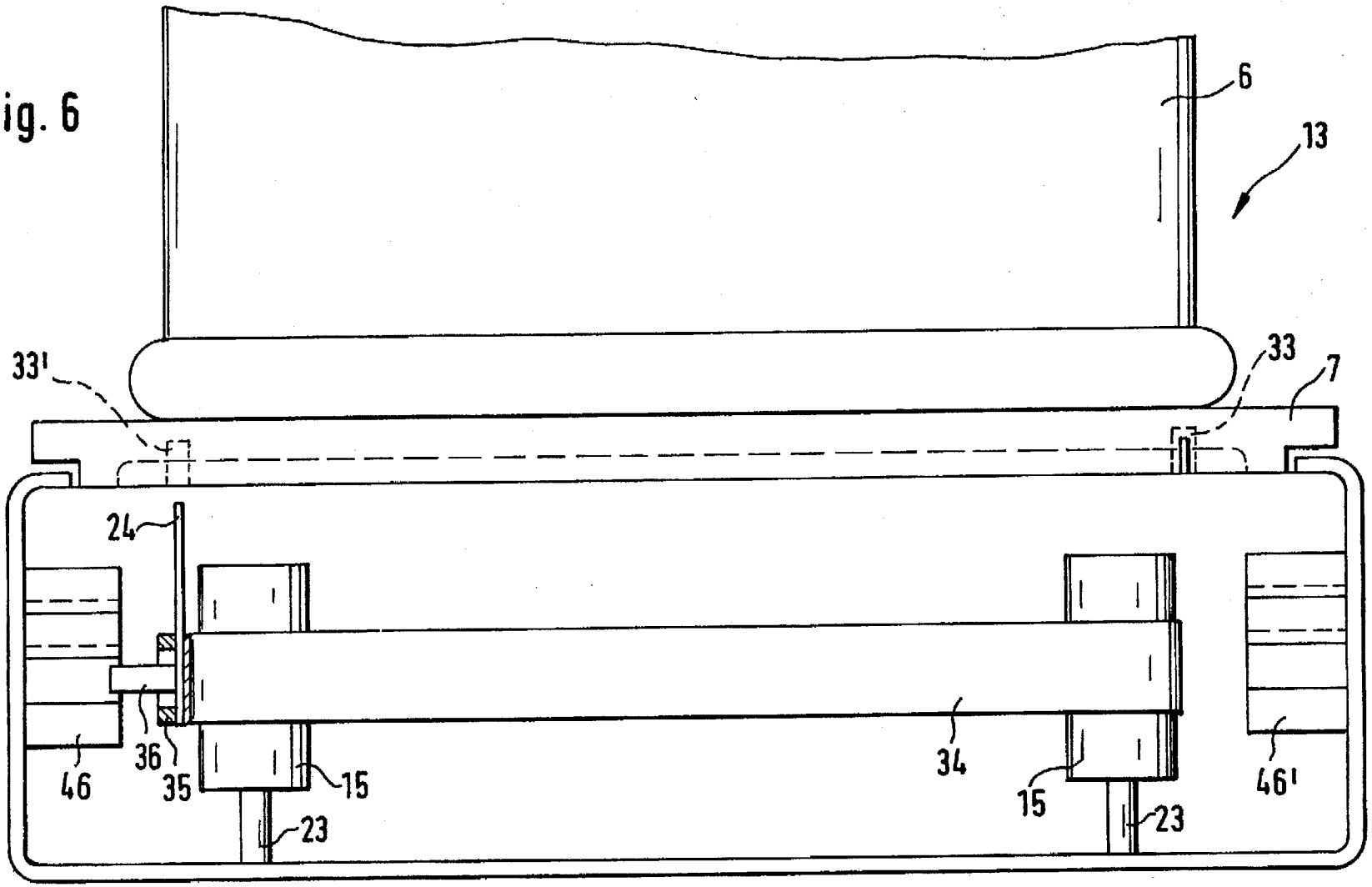
FIG. 6 is a side elevational view of yet another preferred embodiment of the invention.

In the embodiment illustrated in FIG. 6, the reciprocating apparatus 13 has two spaced vertical axes 23 on which support rollers 15 are mounted. The flexible element, constituted by an endless belt 34, is trained about and positioned by the support rollers 15. On the belt 34 a carrier guide 35 is fixedly mounted in which a follower pin 36, affixed to the vertically slidable carrier member, may shift upwardly or downwardly as it travels along the path of reciprocation. The follower pin 36 extends into a cam track 6 which, in the zone of the reversal of the belt 34, is moved downwardly, as a result of which the carrier member 24 moves out of the recess 33' and remains at the lowered level until on the other side the follower pin 36, after reversal by the roller 15, is again raised by virtue of the guiding effect of the cam track 46 guiding the follower pin 36. As a result, the carrier member 24 is raised and projects into the recess 33 of the sled 7 and moves the sled 7 in the opposite direction.

Since in the embodiments according to FIGS. 5 and 6 the flexible member on which the carrier members 24, 24' are mounted travels continuously and unidirectionally, the motor in these two embodiments may be a unidirectional motor and therefore neither a reversible motor nor a path sensor and related accessories are needed.

Figure 7:
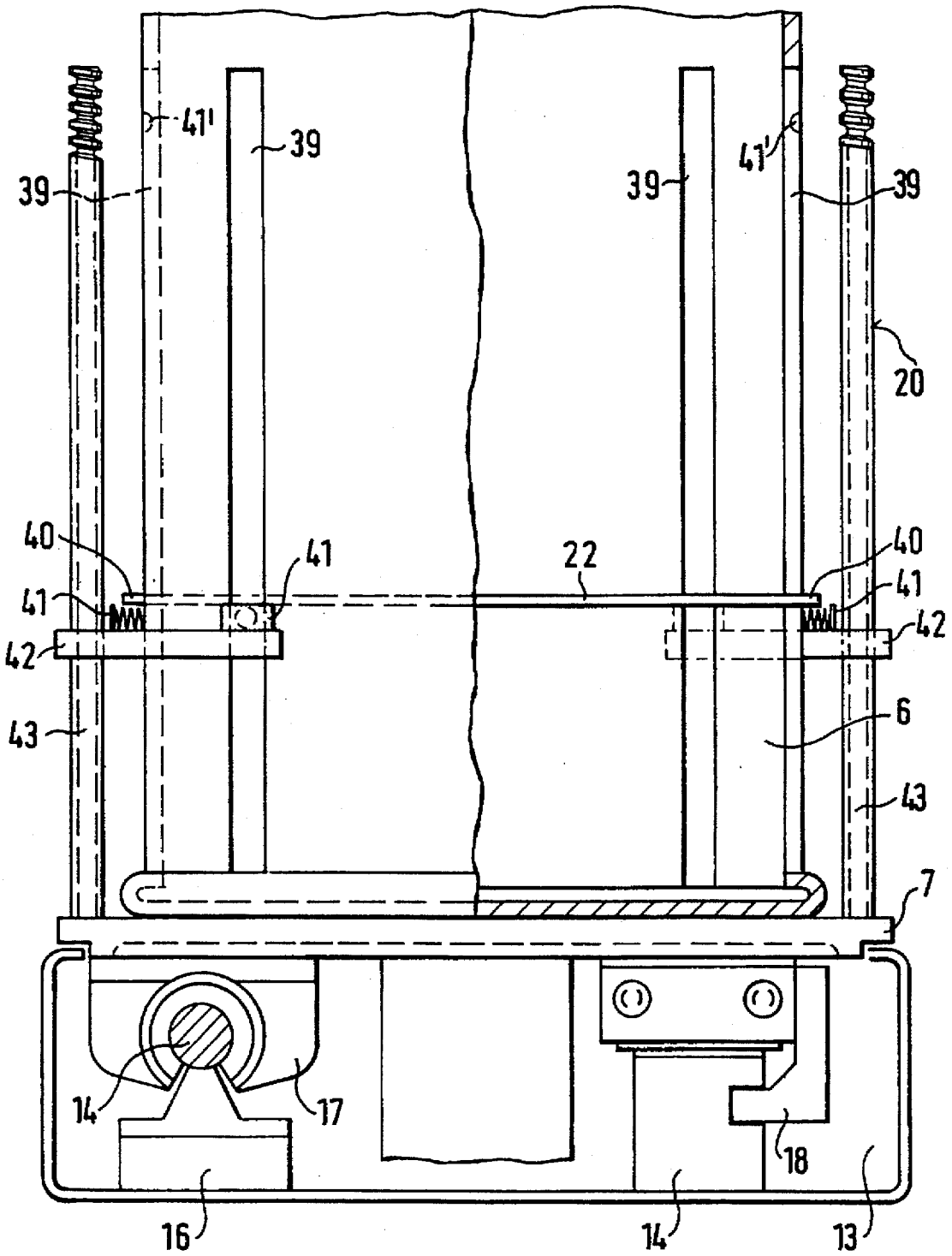
FIG. 7 is a front elevational view of a further embodiment of the invention.

Turning to FIG. 7, there is shown a can bottom shifting (raising and lowering) device 20 mounted on the sled 7. The can 6 is provided with vertical slots 39 in the rounded, narrow sides of the flat can 6. Engagement members 40 mounted on the can bottom 22 project through the slots 39 and may lie on carrier arms 42 of the raising and lowering device 20. The engagement members 40 of the can bottom 22 are associated with stop devices 41, such as ball-type detent devices which, by means of a compression spring, are partially pushed outwardly of the stop device housing as soon as the can bottom 22 has reached an upper position and the balls of the stop device 41 may project into spherical sockets 41' provided in the can wall. The carrier arms 42 are supported on threaded spindles 43 which have a thread of trapezoidal cross section. The spindles 43 are driven by a non-illustrated drive selectively in the one or the other direction whereby the arms 42 threadedly mounted on the spindles 43 are travelling in the upward or downward direction. The stop devices 41 are provided for the event that the can bottom 22 has been raised even before its transfer to the sled 7. In such a case the can shifting device 20 mounted on the sled 7 is designed only for lowering the can bottom 22, whereas a bottom shifting device which attends to the raising of the can bottom externally of the sled 7 is designed only for carrying out lifting operations.

Figure 8:
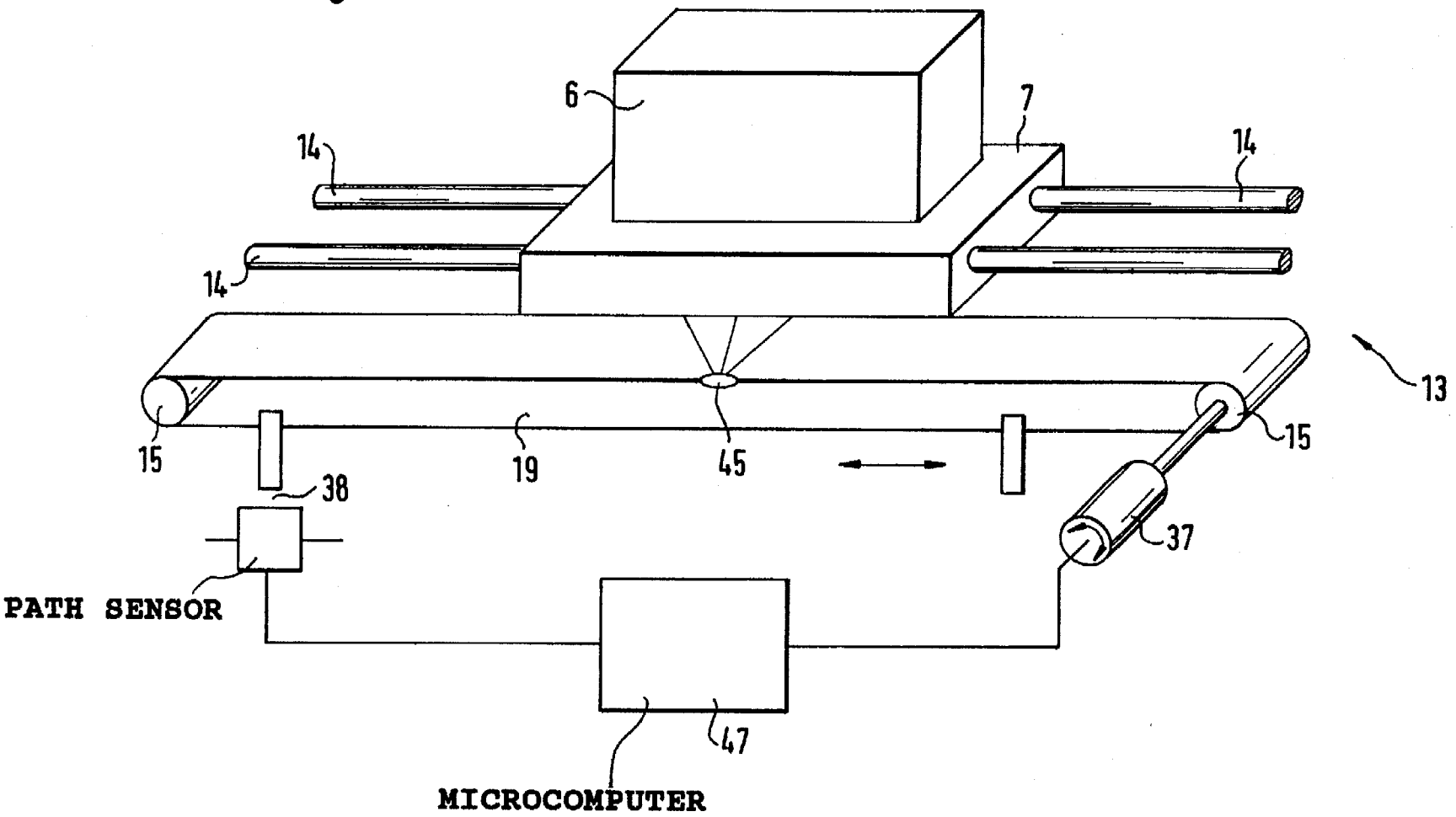
FIG. 8 is a schematic perspective view, with block diagram, of a coiler can reciprocating device according to the inventions.
Figure 9A:
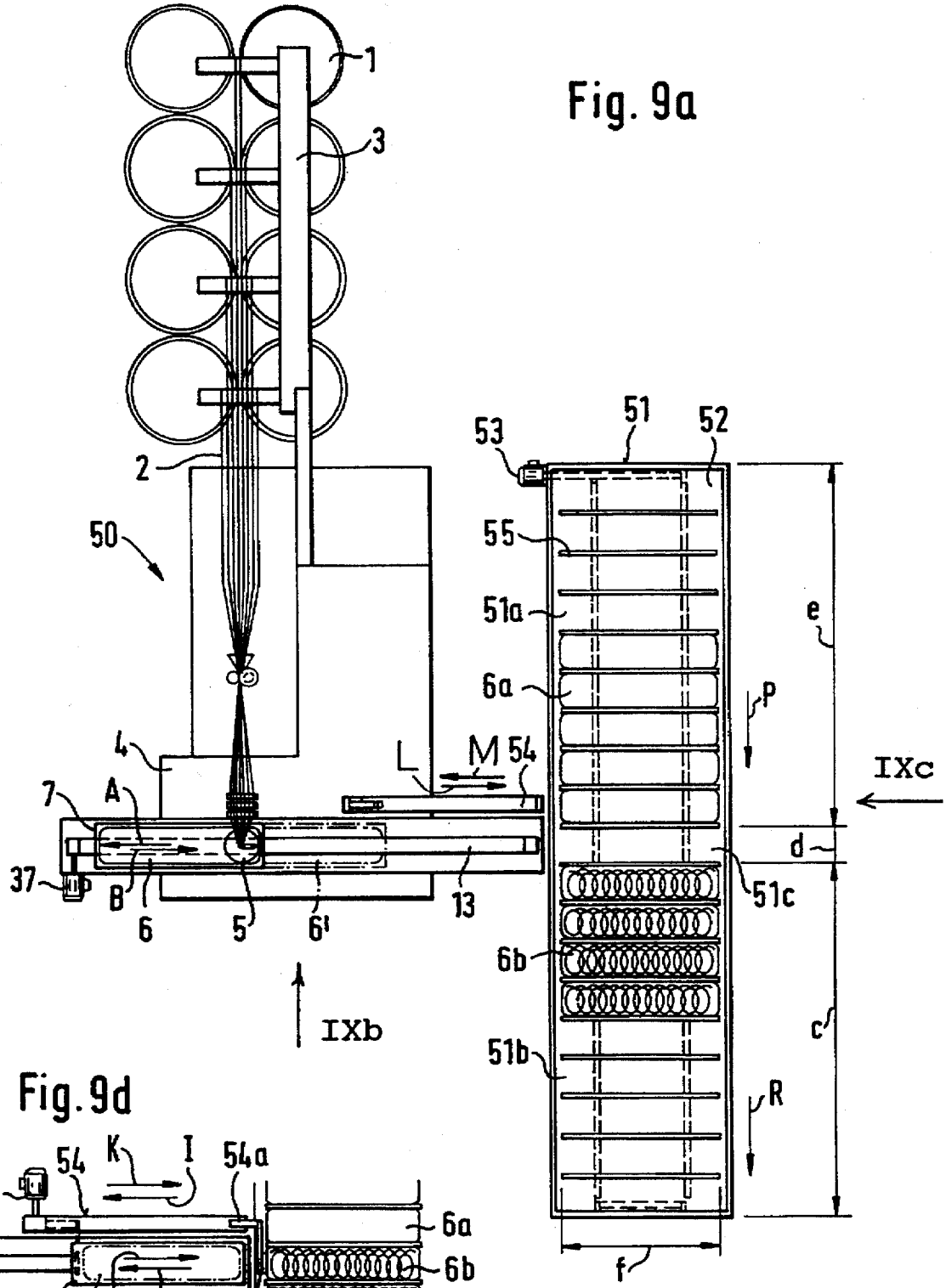
FIG. 9*a* is a schematic top plan view of a drafting frame for charging flat cans with sliver, including transport mechanisms and can storage devices.

FIG. 8 illustrates schematically the can reciprocating device 13 formed of the flexible element 19 supported on end rollers 15, an engagement member 45 secured to the sled 7 and a reversible motor 37 which is controlled by a microcomputer 47 as a function of signals obtained from a path sensor 38. FIG. 9*a* illustrates a drafting frame 50 which may be, for example, a high production drafting frame HS 900 manufactured by Trützschler GmbH & Co. KG, M önchengladbach, Germany. The sliver guiding table 3 of the drafting frame accommodates eight cylindrical coiler cans 1 which were transported from the output side of at least one non-illustrated carding machine. The slivers 2 are taken from the cans 1 and simultaneously fed to a drafting unit 4 which produces a sliver 12.

The strength of the sliver 12 equals that of the individual slivers 2. The sliver 12 is, by means of a coiler head 5, deposited into a can 6 which, after being fully charged, is moved out of the working zone of the coiler head 5. Thereafter, the can 6 is advanced to a non-illustrated open-end spinning machine via a can storage device 51 including a storage conveyor 52 and a non-illustrated transport carriage travelling, for example, on the plant floor.

Figure 9D:
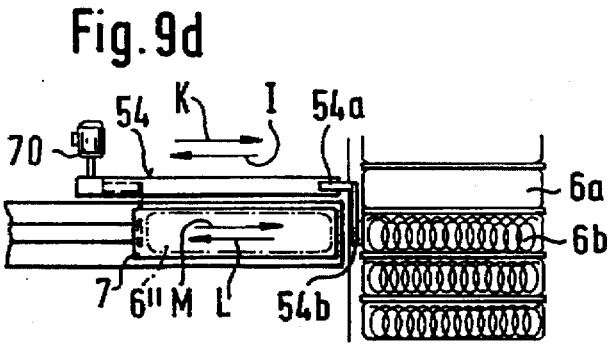
FIG. 9*d* is a top plan view of a can reloading device of a part of the FIG. 9*a* construction, showing further details.
Figure 9B:
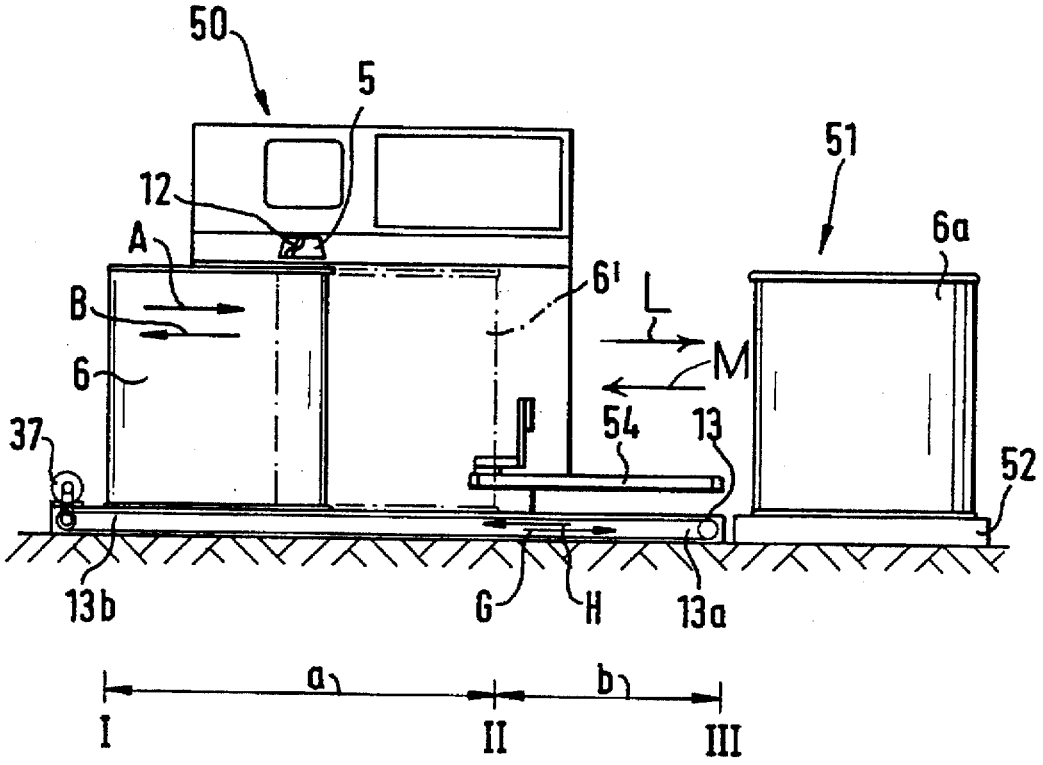
FIG. 9*b* is an elevational view of the construction illustrated in FIG. 9*a*, as seen in the direction of arrow IXb in FIG. 9*a*.

FIG. 9*b* illustrates the sliver charging station in which the flat can 6 is situated and in which it is undergoing sliver charging. The sliver 12 which is the output product of the drafting frame 50 is deposited by the coiler head 5. The sliver 12 is supplied to the coiler head 5 in a conventional manner by two calender rolls upon receipt from the drafting unit of the drafting frame 50. The diameter of the coiler head 5 corresponds approximately to the width of the flat can 6, that is, the distance between two large can sides. The can 6 is positioned on the sled 7. During the charging operation to the sled 7 and thus to the can 6 there is imparted, by means of the reciprocating device 13, a back-and-forth motion in the direction of the arrows A and B whereby the can moves throughout its entire horizontal length back-and-forth underneath the coiler head 5 to thus ensure that the sliver will be deposited over the entire length of the coiler can and, since the diameter of the rotary coiler head corresponds to the horizontal width of the can, sliver deposition will also take place over the entire width of the coiler can. Thus, the reciprocating motion has an amplitude a. In FIG. 9b the coiler can 6a is shown in solid lines at the left end of the reciprocating path, whereas the coiler can 6' shown in phantom lines, is situated at the other (right) end of the reciprocating path. The reciprocating device 13 is driven by an rpm-controlled electromotor 37.

Figure 9C:
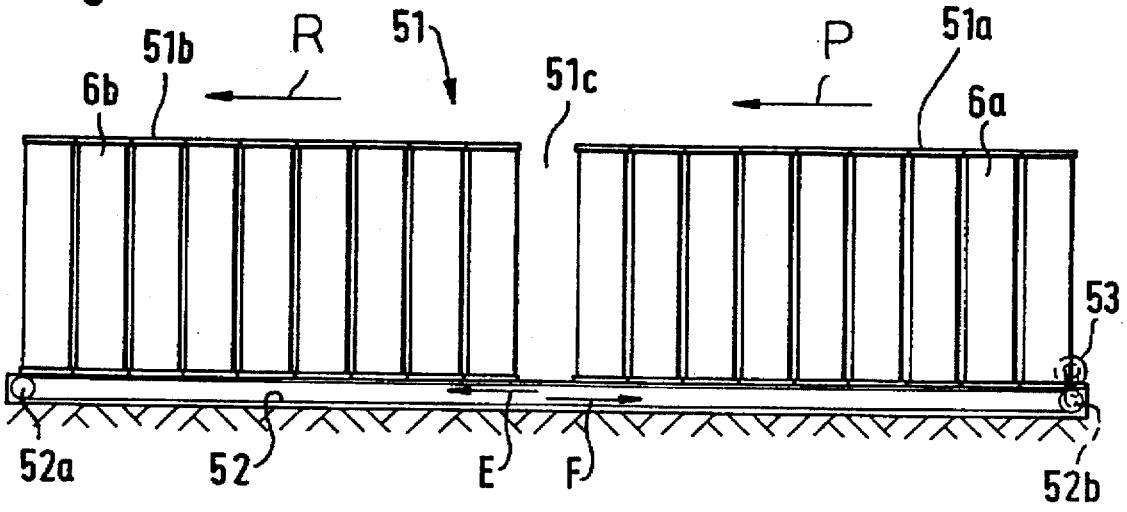
FIG. 9*c* is an elevational view of some components of FIG. 9*a* shown in the direction of arrow IXc of FIG. 9*a*.

Reverting to FIG. 9a and also referring to. FIG. 9c, parallel to the length of the drafting frame a can storage 51 is provided which is formed of an empty-can storage 51 for the empty cans 6a and a full-can storage 51 for the sliver-filled full cans 6b. As viewed in the conveying direction P and R of the storage conveyor (belt) 52, between the last empty can 6a and the first full can 6b an intermediate space 51c is provided. The conveyor belt 52 circulates about end rollers 52a, 52b in the directions E (upper run) and F (lower run), and is driven by an electromotor 53. On the conveyor belt 52 carrier strips 55 are provided which between themselves define emplacements for the cans and are secured to the belt 52 in an orientation perpendicular to the travelling direction P, R. The end roller 52b is driven by the electromotor 53. The conveyor belt structure 52 has a low structural height.

The sliver 12 is discharged by the stationarily supported rotary coiler head 5 and is deposited in coils in the can 6 which, during the discharging operation, executes a back-and-forth motion. Before the charging process an empty can 6a is, for example, from the empty-can storage 51a moved into the intermediate space 51c between the empty-can storage 51a and the full-can storage 51b as indicated by the arrow P and therefrom shifted into the charging position. The can 6 is, in the charging position (charging station) filled with sliver 12 and the full can 6 is, after the charging process, moved out of the charging position into the intermediate space 51c between the empty and full cans 6a, 6b and from there moved into the full-can storage 51b as indicated by the arrow R. As a transport device between the sliver charging station and the empty-can and full-can storages the shifting device 13 and the sled 7 is utilized. The travel path of the sled 7 is at a right angle to the direction of motion of the storage belt 52. The sled 7, when it performs a can-exchanging operation between sliver charging operations, moves a full can 6b from and an empty can 6a towards the coiler head 5. In order to load the empty can 6a before the charging process from the intermediate space 51c onto the sled 7 and to load the full can 6b after the charging process from the sled 7 into the intermediate space 51c a transfer device 54 is provided. The can transfer device 54, as shown in FIG. 9d, includes a pressing and pulling arm 54a which, by means of a pressing and pulling element 54b is shiftable in the direction of the arrows I, K. The pressing and pulling element 54b is driven, for example, by an electromotor 70. It is to be understood that instead of an electromotor a pneumatically operated power device may be used. Thus, as may be observed in FIGS. 9a and 9b, the transfer device 54 either moves an empty can 6a from the intermediate space 51c onto the sled 7 in the direction of the arrow M or it moves a full can 6b from the sled 7 into the intermediate space 51c in the direction of the arrow L. In this embodiment the sled 7 (and its driving mechanism) has thus a dual use: it reciprocates a can in the charging station in the direction of arrows A, B and also functions as a full-can and empty-can conveyor between the can storage device 51 and the charging station underneath the coiler head 5.

As Shown in FIG. 9b the can 6 is reciprocated underneath the coiler head 5 in the direction of arrows A and B along the can charging path a during the sliver charging operation. On the transporting path b either an empty can 6a is moved from the can storage device 51 into the sliver charging station or a full can 6b is moved from the charging station into the can storage device 51 as indicated by arrows L, M.

Figure 10:
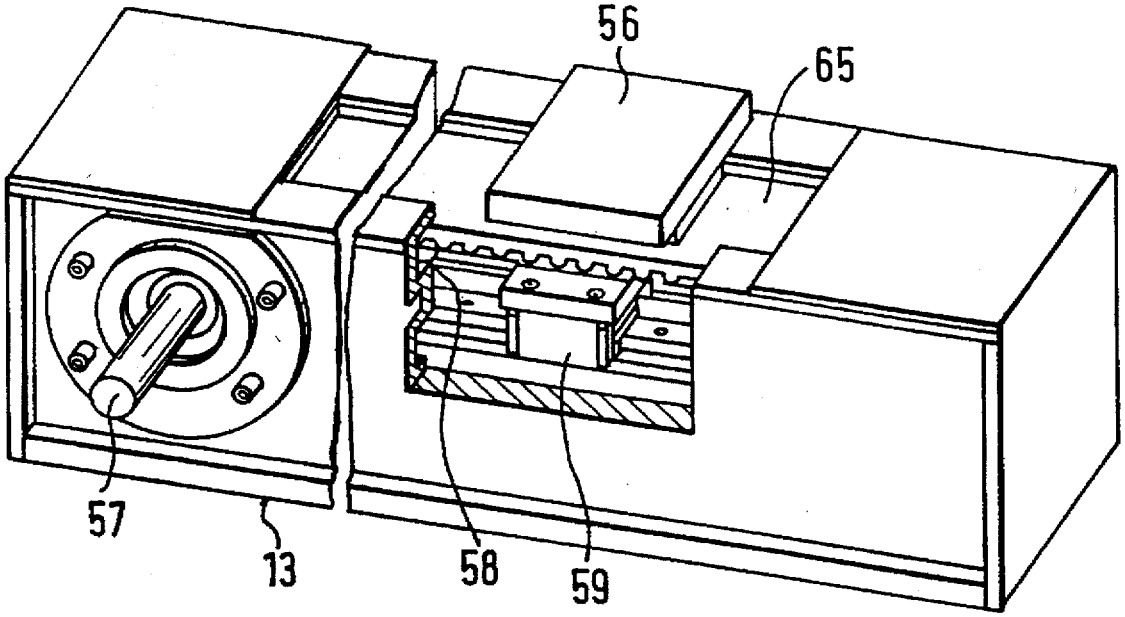
FIG. 10 is a perspective view, partially broken away, of a can reciprocating device according to a further preferred embodiment of the invention.

In FIG. 10 the coiler can reciprocating device 13 includes a toothed belt 65 on which a mounting plate 56 for the sled 7 is secured. A non-illustrated drive motor, such as a reversible motor, is connected to the stub shaft 57 to which a supporting end roller (not visible) for the belt 65 is secured. A slide track 58 is affixed to the device housing to guide therealong a member 59 to ensure linear motion.

Turning to FIG. 11, there is illustrated therein an electronic control and regulating device such as a microcomputer 47 which is connected to the electromotor 37 with intermediary of a motor regulator 60. The electromotor 37 which may be a d.c. or a.c. servomotor is connected with the regulator 60 with the intermediary of an rpm inputter 61. The drive motor 37 is connected with the microcomputer 47 via a path sensor (displacement indicator) 38, such as an incremental path sensor. To the microcomputer 47 there are further connected a terminal 62, sensors 63, an actuating member 64, a drive 70 for the can transfer device 54, the motor 53 for the storage conveyor 52 as well as measuring and setting members for the control and regulation of the drafting frame 50.

The path sensor 38 reports to the microcomputer 47 the momentary location of the can 6 undergoing charging by sliver. The length of the path a along which the can 6 is reciprocated during the charging operation is structurally determined and is, by way of a program, stored into the microcomputer 47 (the reversal points are, for example, I=0 and II=100). As long as the can 6 is not fully charged, it is continuously and with a predetermined speed v reciprocated between the terminal points (I and II). As soon as the maximum fill height is reached which is determined by a fill state sensor 63, the can 6 is moved beyond the terminal point II to the point III. From there the can is laterally moved away in order to be able to bring a new empty can 6a to the location III. The presence of such a new can at location III is sensed and the can is brought onto the path a, whereupon the charging cycle restarts.

The velocity v with which the can 6 is reciprocated between the terminal points (I and II) of the path a is variable and may be predetermined by the microcomputer 47 and signalled to the motor regulator 60 according to requirements. Particularly shortly before reaching the terminal points the program may provide for an appropriate deceleration. Upon reaching of the points of reversal, the direction of motion is reversed and accordingly, as dictated by the program, the can is accelerated as may be seen in the speed/time diagrams of FIGS. 12a and 12b. The electromotor 37 may be, for example, constantly accelerated or decelerated. It may also be expedient to compensate for the overlap of the deposited sliver coils at the reversal points by appropriate acceleration or deceleration. The velocity v with which the can 6 is reciprocated along the path a during the charging process is dependent from the delivery speed of the sliver discharged by the drafting frame 50 and is directly synchronized therewith by electronic means. The speed with which the can 6 is moved on the transporting path b may be coordinated with the can charging operation. It is to be understood that instead of a sled 7 the can reciprocating device 13 may also move a wheeled carriage or the like.

The invention also encompasses an embodiment in which the can reciprocating device 13 is directly connected to the can 6 which is moved on a conveyor track, for example, a roller track.

It will be understood that the above description of the present invention is susceptible to various modifications, changes and adaptations, and the same are intended to be comprehended within the meaning and range of equivalents of the appended claims.

What is claimed is:

1. A combination of a high-production rate sliver producing machine with a system for charging a coiler can of elongated horizontal cross section with sliver obtained from the sliver producing machine, said sliver producing machine comprising a stationarily supported rotary coiler head having a diameter generally corresponding to the width of said coiler can for discharging sliver in coils;

said system comprising (a) a coiler can having two opposite first sides and two opposite second sides oriented generally perpendicularly to said first sides; said coiler can having an elongated horizontal cross-sectional outline having a length corresponding to a distance between said second sides and a width corresponding to a distance between said first sides; said length being greater than said width;

(b) a sled disposed underneath said coiler head; said sled having an upper supporting surface for accommodating said coiler can in a standing position thereon, whereby said sled provides a vertical support for said coiler can; and (c) sled-reciprocating means for imparting a sufficiently rapid back-and-forth motion to said sled parallel to the length of the coiler can to effect a deposition of sliver coils into the coiler can along a length thereof during discharge of sliver from said sliver producing fiber processing machine at a sliver discharge speed in an order of magnitude of 1,000 m/min.

2. The system as defined in claim 1, further comprising can bottom shifting means mounted on said sled for vertically shifting a movable bottom of a coiler can positioned on said sled.

3. The system as defined in claim 1, further comprising stationarily mounted spaced guided bars extending parallel to a direction parallel to said back-and-forth motion and guide elements affixed to said sled and slidingly engaging said guide bars.

4. The system as defined in claim 1, wherein said sled-reciprocating means comprises a drive including a frequency-controlled a.c. servomotor.

5. The system as defined in claim 1, further wherein said sled-reciprocating means comprises a drive including an rpm-regulated electric motor and control means for setting predetermined rpm's for said electric motor.

6. The system as defined in claim 1, further comprising a microcomputer operatively connected to said sled-reciprocating means and said coiler head.

7. The system as defined in claim 6, further comprising a displacement sensor cooperating at least indirectly with said sled and being connected to said microcomputer for determining positions of said sled along a travel path thereof.

8. A system for charging a coiler can of elongated horizontal cross section with sliver obtained from a sliver producing fiber processing machine, comprising (a) a coiler can having two opposite first sides and two opposite second sides oriented generally perpendicularly to said first sides; said coiler can having an elongated horizontal cross-sectional outline having a length corresponding to a distance between said second sides and a width corresponding to a distance between said first sides; said length being greater than said width;

(b) a stationarily supported rotary coiler head having a diameter generally corresponding to the width of said coiler can for discharging sliver in coils;

(c) a sled disposed underneath said coiler head; said sled having an upper supporting surface for accommodating said coiler can in a standing position thereon, whereby said sled provides a vertical support for said coiler can; and (d) sled-reciprocating means for imparting a back-and-forth motion to said sled parallel to said coiler can during discharge of sliver from said coiler head to effect a deposition of sliver coils into the coiler can along a length thereof; said sled-reciprocating means including (1) a drive;

(2) a horizontal, endless belt situated underneath said sled and having a length portion extending parallel to a direction of said back-and-forth motion; said drive being connected to said belt for moving said belt parallel to said direction; said belt having first and second longitudinal runs extending parallel to said direction and travelling in an opposite sense relative to one another;

(3) end rollers about which said belt is trained;

(4) a carrier element force-transmittingly coupling said belt to said sled; said carrier being mounted on said belt and being slidable relative to said belt into and out of force-transmitting engagement with said sled;

(5) a follower affixed to said carrier element; and (6) a stationarily supported cam track extending along said belt and guiding said follower; said cam track including guide means for maintaining said carrier element in a force-transmitting engagement with said sled when said carrier element is travelling along said first and second longitudinal runs of said belt and for disengaging said carrier element from said sled in a transition zone of said belt from one of said first and second longitudinal runs to the other of said first and second longitudinal runs.

9. A system for charging a coiler can of elongated horizontal cross section with sliver obtained from a sliver producing fiber processing machine, comprising (a) a coiler can having two opposite first sides and two opposite second sides oriented generally perpendicularly to said first sides; said coiler can having an elongated horizontal cross-sectional outline having a length corresponding to a distance between said second sides and a width corresponding to a distance between said first sides; said length being greater than said width;

(b) a stationarily supported rotary coiler head having a diameter generally corresponding to the width of said coiler can for discharging sliver in coils;

(c) a sled disposed underneath said coiler head; said sled having an upper supporting surface for accommodating said coiler can in a standing position thereon, whereby said sled provides a vertical support for said coiler can;

(d) sled-reciprocating means for imparting a back-and-forth motion to said sled parallel to said coiler can during discharge of sliver from said coiler head to effect a deposition of sliver coils into the coiler can along a length thereof; said sled-reciprocating means including (1) a drive;

(2) an elongated flexible element having a length portion extending parallel to a direction of said back-and-forth motion; said drive being connected to said flexible element for moving said flexible element parallel to said direction; and (3) connecting means for force-transmittingly coupling said flexible element to said sled; and (e) first and second stationarily supported, spaced guide bars extending parallel to said direction; first and second slide members affixed to said sled; said first slide member snugly surrounding said first guide bar and said second slide member engaging said second guide bar with a play.

10. A system for charging a coiler can of elongated horizontal cross section with sliver obtained from a sliver producing fiber processing machine, comprising (a) a coiler can having two opposite first sides and two opposite second sides oriented generally perpendicularly to said first sides; said coiler can having an elongated horizontal cross-sectional outline having a length corresponding to a distance between said second sides and a width corresponding to a distance between said first sides; said length being greater than said width;

(b) a stationarily supported rotary coiler head having a diameter generally corresponding to the width of said coiler can for discharging sliver in coils;

(d) a sled disposed underneath said coiler head; said sled having an upper supporting surface for accommodating said coiler can in a standing position thereon, whereby said sled provides a vertical support for said coiler can; and (d) sled-reciprocating means for imparting a back-and-forth motion to said sled parallel to said coiler can during discharge of sliver from said coiler head to effect a deposition of sliver coils into the coiler can along a length thereof; said sled-reciprocating means including (1) a drive comprising a unidirectional motor and a coupling device;

(2) an elongated flexible element having a length portion extending parallel to a direction of said back-and-forth motion; said drive being connected to said flexible element for moving said flexible element parallel to said direction; said flexible element comprising first and second horizontal, endless belt spaced from one another transversely to said direction; each said endless belt having a first belt run proximal to said sled and a second belt run distal from said sled; said coupling device including means for coupling the motor to said first and second endless belts such that said first and second endless belts are driven in opposite directions;

(3) end rollers positioning said first and second endless belts;

(4) connecting means for force-transmittingly coupling said flexible element to said sled; said connecting means comprising a first carrier element attached to said first endless belt and a second carrier element attached to said second endless belt; each said first and second carrier element being in a force-transmitting relationship with said sled when travelling in said first belt run and being disengaged from said sled when travelling in said second run; said first and second carrier elements being positionally related to one another such that said first and second carrier elements at all times travel on unlike belt runs, whereby upon disengagement of one of said first and second carrier elements from said sled at an end of a reciprocating path thereof, engagement with said sled by the other of said first and second carrier elements occurs for alternatingly carrying said sled in opposite directions.

11. The system as defined in claim 10, wherein said belt extends underneath said sled parallel to said direction and further wherein said first belt run extends above said second belt run.

* * * * *